US005475386A

United States Patent [19]

Luoma

[11] Patent Number: 5,475,386

[45] Date of Patent: Dec. 12, 1995

[54] PORTABLE FOLDING STANDARD AND TRAFFIC SIGNAL APPARATUS

[75] Inventor: Eugene H. Luoma, Duluth, Minn.

[73] Assignee: ADDCO Manufacturing, Inc., St. Paul, Minn.

[21] Appl. No.: 173,641

[22] Filed: Dec. 22, 1993

[51] Int. Cl.[6] ..... G08G 1/095

[52] U.S. Cl. ..... 340/908; 340/471; 340/473; 116/63 P; 40/590; 40/610

[58] Field of Search ..... 340/908, 908.1, 340/471, 473; 116/63 P, 63 R; 40/590–592, 607, 610; 248/371, 158, 160, 161, 124, 207

[56] References Cited

U.S. PATENT DOCUMENTS

| | | | |
|---|---|---|---|
| 3,702,033 | 11/1972 | Coleman | 40/129 R |
| 3,883,846 | 5/1975 | Bruner | 340/908 |
| 4,077,144 | 3/1978 | Smits | 40/590 |
| 4,087,785 | 5/1978 | Dodich | 40/550 |
| 4,271,408 | 6/1981 | Teshima et al. | 40/564 |
| 4,543,905 | 10/1985 | McKenney | 116/63 P |
| 4,569,495 | 2/1986 | Woudenberg et al. | 40/608 |
| 4,571,868 | 2/1986 | Forestal | 40/590 |
| 4,593,265 | 6/1986 | McKenney | 40/590 |
| 4,616,225 | 10/1986 | Woudenberg | 340/908 |
| 4,992,788 | 2/1991 | Arndt | 340/908 |
| 5,257,020 | 10/1993 | Morse | 340/908.1 |

OTHER PUBLICATIONS

Product Brochure, 2 pp. Bemis . . . the name in Flashing Arrows! Dec. 1993.

Product Brochure, 2 pp. Traffic Control Products from Signal Traffic Controller, Feb. 1981.

*Primary Examiner*—Donnie L. Crosland

*Attorney, Agent, or Firm*—Palmatier, Sjoquist & Helget

[57] ABSTRACT

A trailer mounted apparatus for use along roadways and convertible between a folded-transport position and an erected-operational position. When in the operating position, one signal unit is elevated on the side of the roadway, and another signal unit is elevated over a traffic lane at sufficient height so as to not pose a hazard to traffic. The apparatus has a fixed upright mast with a hinged mast extension which angles upwardly and laterally away from the top of the upright mast. A foldable arm with inner and outer arm portions is hinged to the top portion of the mast extension. When in the erected position alongside a roadway, the mast extension elevates the foldable arm which extends from the top portion of the mast extension across the trailer and out and over the traffic lane. One signal unit is attached to the outer end of the foldable arm and the other unit is attached to the mast extension. In the transport position the mast extension, the foldable arm, and the signal units lie horizontally and compactly folded within the confines of the trailer. Hydraulic cylinders are utilized to raise and lower the mast extension with respect to the mast, and the foldable arm with respect to the mast extension. A rigid link unfolds and folds the foldable arm as the foldable arm is raised and lowered.

19 Claims, 4 Drawing Sheets

PORTABLE FOLDING STANDARD AND TRAFFIC SIGNAL APPARATUS

BACKGROUND OF THE INVENTION

The present invention relates to traffic signaling devices. More particularly, it relates to a portable standard and traffic signaling device which may be erected to position temporary traffic signals alongside and over a roadway.

Traffic control signals are extensively relied upon to assist in moving traffic quickly, efficiently, and safely. There is often a need for temporary traffic control signals at construction sites, in situations where there is higher than normal traffic, or at locations where the normal traffic control has been knocked out by power outages or by accidents. Obviously, high visibility of traffic control signals is always important, especially in high traffic areas. Ideally, the traffic control signal whether temporary or permanent, should be elevated above and over the flow of traffic for maximum visibility.

Typically, the areas where temporary traffic signal devices are needed are areas of high traffic congestion. Delay in the set up of the temporary devices compounds the congestion problems. Emergencies where there are power outages or accidents often require immediate, temporary, traffic control. In such situations it is advantageous, if not critical, to provide portable, temporary, traffic signaling equipment. Additionally, it would be highly beneficial to be able to quickly maneuver the temporary traffic signaling apparatus into place and to provide quick set up.

Due to the environment in which portable traffic signal apparatus are used, that is in emergency situations and in areas of high traffic, it is important to have a mechanically reliable device. For maximum reliability it is generally beneficial to have simplicity in design, a minimal number of moving or operational parts, and to have the operational parts easily accessible for service and repair.

SUMMARY OF THE INVENTION

The present invention is a trailer mounted portable folding standard and traffic signal apparatus for temporary use at locations along roadways. The apparatus is convertible between a folded-transport position and an erected-operational position. The apparatus has two signal units. When in the operating poistion, one signal unit is elevated on the side of the roadway, and the other signal unit is elevated over a traffic lane at sufficient height so as to not pose a hazard to traffic. The apparatus has a fixed upright mast with a hinged mast extension which angles upwardly and laterally away from the top of the upright mast. A foldable arm with inner and outer arm portions is hinged to the top portion of the mast extension. When in the erected position alongside a roadway, the mast extension elevates the foldable arm which extends from the top portion of the mast extension across the trailer and out and over the traffic lane. One signal unit is attached to the outer end of the foldable arm and the other unit is attached to the mast extension. In the transport position the mast extension, the foldable arm, and the signal units lie horizontally and compactly folded within the confines of the trailer. Hydraulic cylinders are utilized to raise and lower the mast extension with respect to the mast, and the foldable arm with respect to the mast extension. A connecting link connecting the top portion of the mast extension to the outer arm portion operates to unfold and fold the inner and outer arm portion of foldable arm simultaneously as the inner arm portion is raised and lowered with respect to the mast extension.

An object and advantage of the invention is to provide a self-contained portable standard and traffic control signal apparatus that is compact in the transportation position and, when erected, extends a foldable arm from the road shoulder to a significant distance out over a traffic lane.

An object and advantage of the invention is that the conversion from the transport position to the operating position may be quickly and simply accomplished in a minimum number of steps. The conversion is accomplished by positive displacement of two hydraulic cylinders.

An object and advantage of the invention is that the angled arm allows a minimal number of structural elements to provide maximum elevation and maximum extension of the signal unit over the roadway. The minimal number of elevated structural elements reduce the elevated weight and provide for better stability of the apparatus.

Another advantage of the invention is that while in use the trailer is parked on the shoulder parallel to the traffic lane and the folding arm extends laterally from the trailer over the traffic lane. This simplifies the placement and removal of the apparatus at needed locations compared to an apparatus where the signal unit extends longitudinally from the front or rear of the vehicle.

Another advantage of the invention is that there is a minimal number of moving or operational parts compared to the prior art and the moving parts are generally easily accessible lending towards greater reliability and ease of maintenance.

An additional advantage of the apparatus is that while in the transportation position the apparatus is compactly folded together, efficiently utilizing the trailer area and providing optimal extension of the signal unit for a given trailer size. Additionally, when in the transport position the apparatus has a minimal frontal profile for low wind resistance for easier towing.

A feature of the invention is that in the erected operating position the utilization of the angled mast extension provides an effective lateral weight distribution of the mast extension, the foldable arm, and the signal unit on the vehicle. This provides stability and minimizes the necessary width of the trailer and reduces the need for supplemental lateral support jacks extending from the side of the trailer. This design also reduces the bending moment in the vertical mast allowing reduction in the sizing of the vertical mast and the associated supports.

In the folded transport position, the angled mast extension allows the inner arm portion of the foldable arm to lie obliquely over the trailer permitting the inner arm portion to be a greater length for a given longitudinal distance within the trailer.

Another advantage of the arrangement of the apparatus is that signal units remain attached to the apparatus in both the operating position and the transport position and are facing downward in the transport position, minimizing the potential of breakage from projectiles. The downward orientation also provides protection from the elements while in the transport position.

An additional feature of the invention is the connecting link which folds and unfolds the foldable arm as the arm is lowered and raised. This reduces the required number of hydraulic cylinders or other actuating means and provides a positive locking effect in all positions of the arm.

DETAILED DESCRIPTION OF THE PREFERRED EMBODIMENTS

Figure 1:
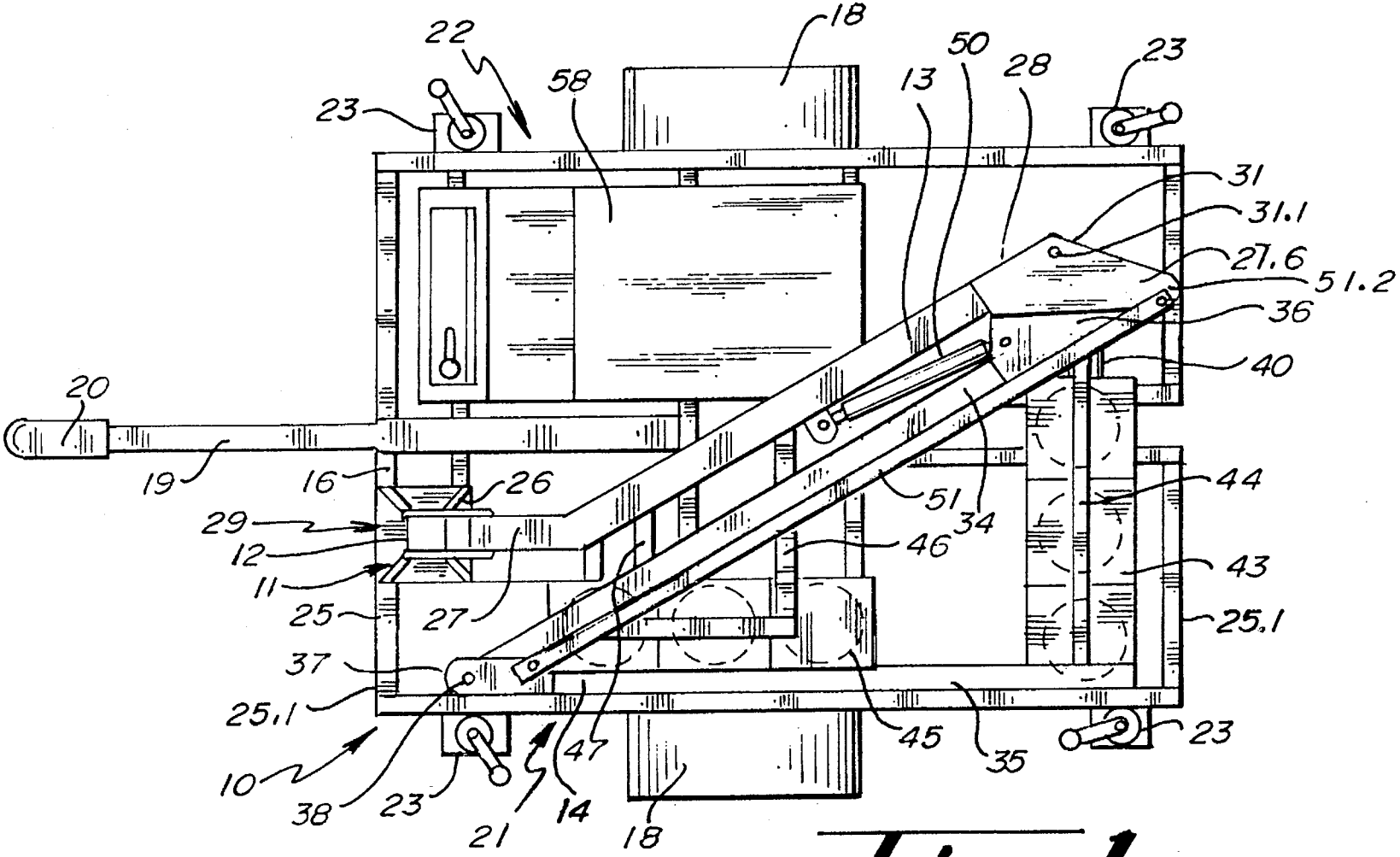
FIG. 1 shows a plan view of the trailer mounted portable folding standard and traffic signal apparatus in the transport position.
Figure 3:
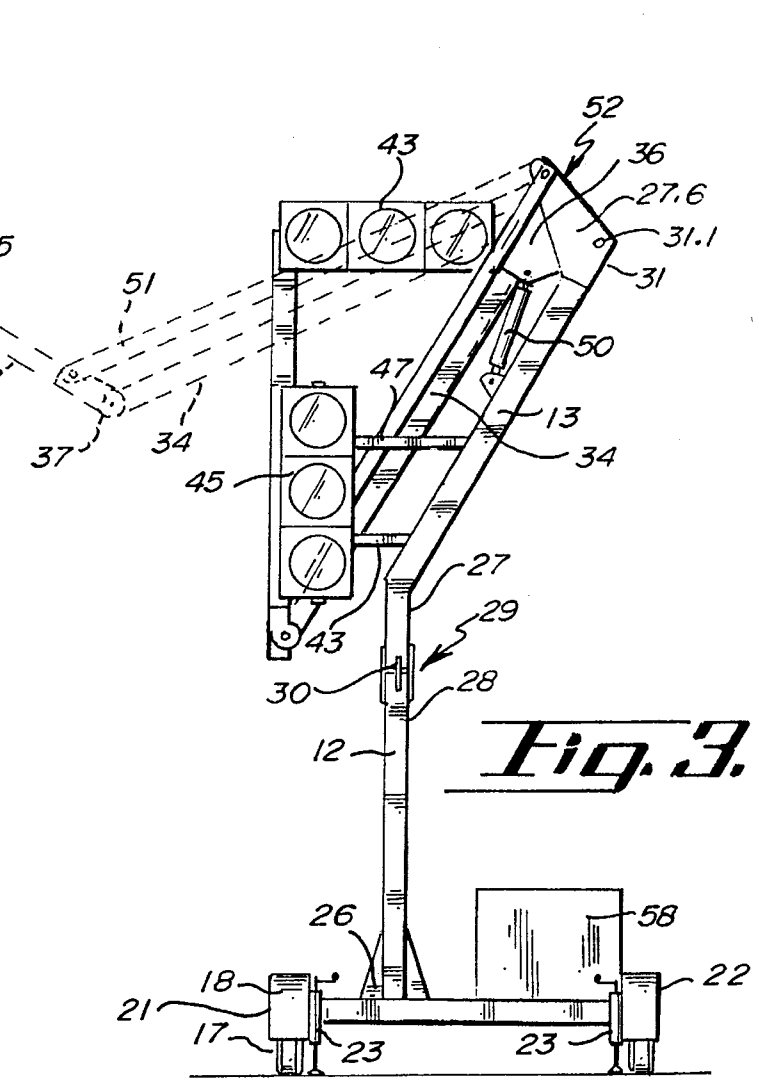
FIG. 3 shows an elevation from the rear of the apparatus with the apparatus in an intermediate position between the transport position and the operating position, and a dotted line position showing the foldable arm partially unfolded.
Figure 2:
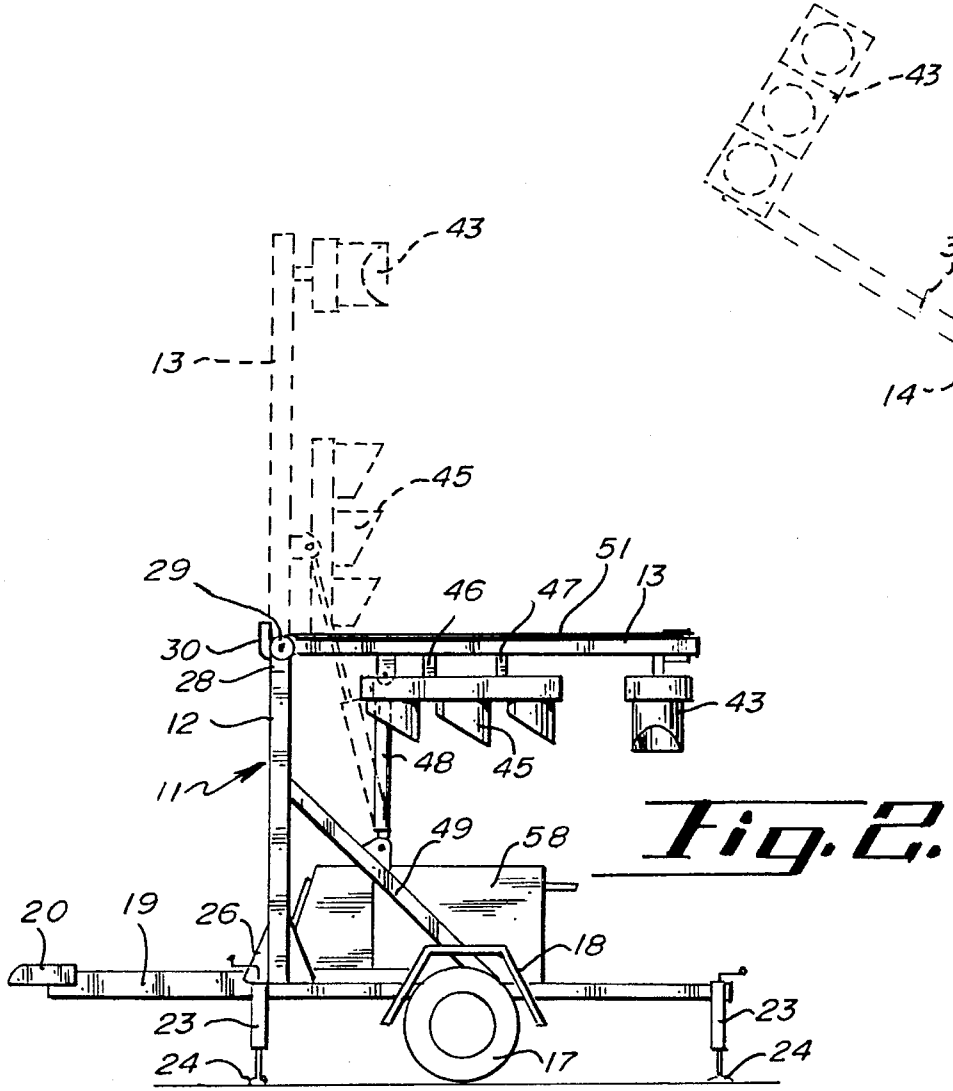
FIG. 2 shows a side elevation view of the apparatus in the transport position.
Figure 4:
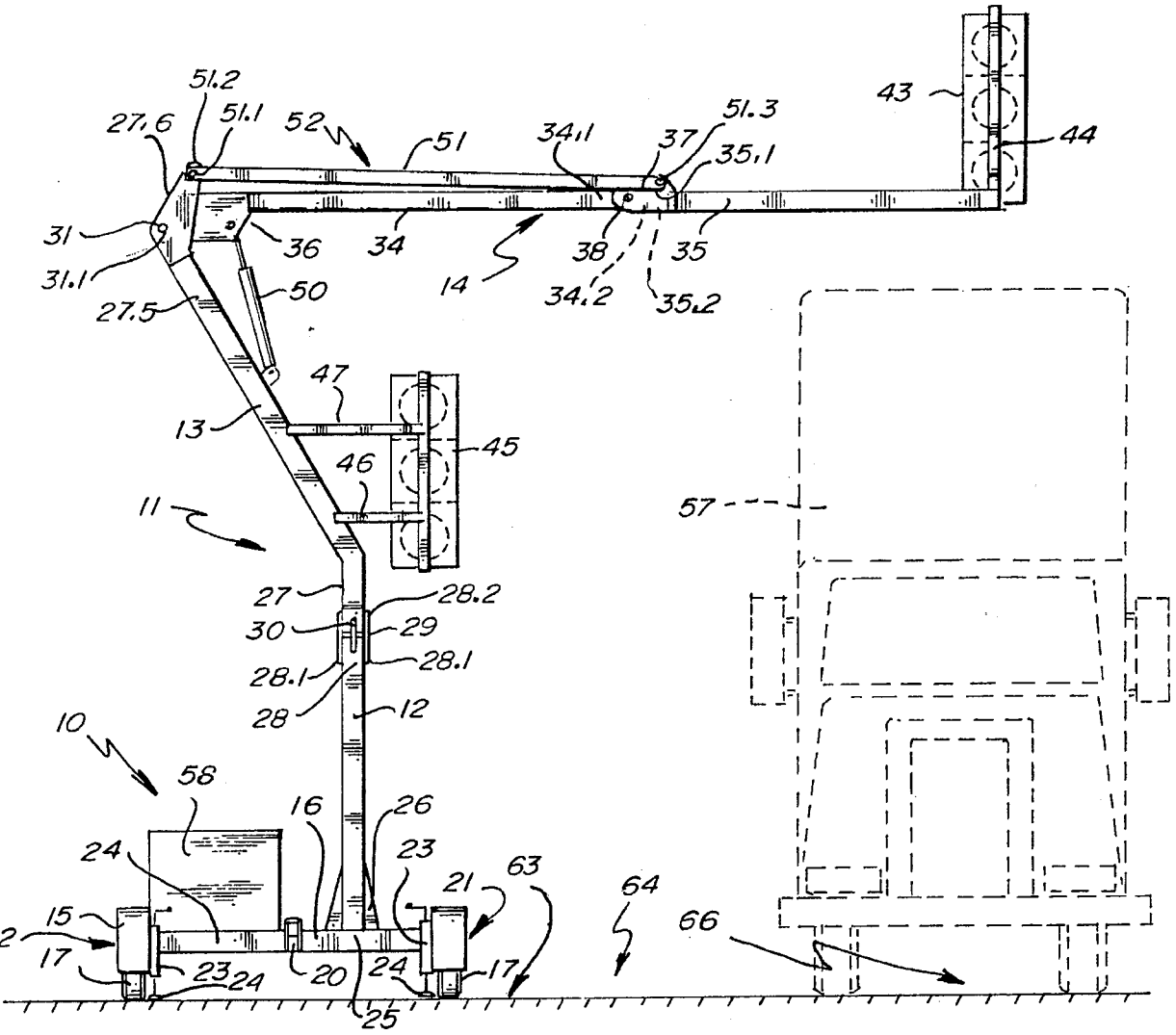
FIG. 4 shows a front elevation view of the apparatus in the erected operating position.

A preferred embodiment of the portable folding standard and traffic signal apparatus is shown in FIGS. 1–4 and is generally indicated by the reference numeral 10. FIG. 1 shows the folding standard 11, consisting of an upright mast 12, an elongate and tiltable mast extension 13, and an elongate foldable arm 14 compactly folded within the confines of a trailer 15 in the transport or storage position. FIGS. 2 and 3 show the folding standard 11 in an intermediate position between the transport position and the operating position. FIG. 4 shows the apparatus 10 in the operating position with the mast extension 13 upright and the foldable arm 14 fully extended to extend outwardly over an adjacent lane of traffic.

The vehicle on which the folding standard 11 is mounted is shown as the trailer 15, although it should be recognized that other embodiments could utilize other types of vehicles including motorized vehicles. The folding standard 11 is particularly suitable for mounting on a truck bed. The trailer 15 has a rigid frame 16, two support wheels 17 located under two fenders 18, a tongue 19, extending from the frame 16, and a trailer hitch 20 mounted on the tongue 19 for connection to a suitable towing vehicle (not shown). As shown in FIG. 1, the trailer 15 also has a left side 21, a right side 22, a front 25, and a perimeter 25.1. Affixed to the frame 16, as by welding, on the left side 21 and on the right side 22 of the trailer 15 are four jacks 23 with pads 24 which are bolted or welded to the frame 16 and are used for leveling and providing support of the apparatus 10, particularly when the apparatus is in the erected or operating position.

As best shown in FIGS. 2, 3, & 4, the stationary and rigid upright mast 12 is affixed to the trailer frame 16 as by welding at the front 25 of the trailer 15 and is further braced by support fins 26 also welded to the frame. The upright mast 12 may be suitably fabricated from five inch square steel tubing.

Referring to FIGS. 1, 3, and 4, hinged to a top portion 28 of the upright mast 12 at a hinged joint 29 is the elongate and tiltable mast extension 13 which has an elongate lower portion 27 integral with an upper portion 27.5. The hinged joint 29 permits the mast extension 13 to be tilted up or down between an upright position corresponding to the operating position, as illustrated in FIG. 4 and the dashed line position of FIG. 2, and a lowered, substantially horizontal position as illustrated in full lines in FIG. 2 corresponding to the transport or storage position. The hinged joint 29 may be conventionally fabricated with plates 28.1 welded to the top portion 28 of the mast 12 and pivotally affixed to the lower portion 27 of the mast extension 13 by way of a pin 28.2. A stop tab 30 welded to the top portion 28 operates to prevent the upward tilting of the mast extension 13 beyond the upright position. The upper portion 27.5 of the mast extension 13 extends obliquely of the lower portion 27 at an angle of approximately 150° . The oblique angle provides two significant functions. First, it provides stability to the apparatus when in the operating position by evenly distributing the weight of the foldable arm 14 laterally across the trailer 15 as best shown in FIG. 4. Secondly, in the transport position, the oblique angle positions the foldable arm 14 diagonally and lengthwise within the confines of the perimeter 25.1 of the trailer 15 to allow the compact storage configuration shown in FIGS. 1 and 2.

Referring to FIGS. 1, 3 and 4, a swing joint or pivot 31 swingably connects to the upper portion 27.5 of the mast extension 13 to the foldable arm 14. The swing joint 31 is comprised of a swing joint bracket 27.6 welded to the upper portion 27.5 and a cooperating bracket portion 36 welded to the foldable arm 14. A pin 31.1 pivotally connects the swing joint bracket 27.6 and the bracket portion 36 to make the swing joint 31. The swing joint bracket 27.6 and the bracket portion 36 may be fabricated out of suitably shaped plate stock.

As best shown in FIGS. 1, 3, and 4, the foldable arm 14 is comprised of an inner arm portion 34 affixed to the bracket portion, and pivotally connected at an elbow joint 37 to an outer arm portion 35. The inner arm portion 34 of the foldable arm 14 is shown in FIG. 1 lying alongside and substantially parallel to the mast extension 13 which corresponds to the transport position. FIG. 4 shows the apparatus 10 in the operating position with the foldable arm 14 swung upward forming an angle of approximately 60° relative to the mast extension 13. The elbow joint 37 is comprised of an end portion 34.1 integral with the inner arm portion, a connecting bracket 35.1 affixed to the outer arm portion, the end portions 34.1 and the connecting bracket 35.1 pivotally connected by way of a pin 38. The end portion 34.1 and connecting bracket 35.1 each have respective engagement faces 34.2, 35.2 which confront each other and make contact, as shown by the phantom lines in FIG. 4, when the foldable arm 14 is fully extended. The engagement surfaces 34.2, 35.2 function to restrict the elbow joint 37 from opening more than 180° . The connecting bracket 35.1 may be conventionally fabricated from two parallel, suitably shaped plates welded to the four inch tubing of the outer arm portion 35.

Affixed to the outer arm portion 35 of the foldable arm 14 is a first signal unit 43 attached by way of the support 44. FIG. 1, depicting the apparatus 10 in the transport position, shows the first signal unit 43 facing downward towards the trailer 15. FIG. 1 also shows a second signal unit 45, also oriented downward, attached to the mast extension 13 by way of connecting supports 46, 47. The downward orientation provides protection from the elements when in the transport position but still allows easy access for servicing. The signal units 43, 45 shown are of the conventional type of red, yellow, and green lights and with conventional electrical wiring and circuitry, not shown. Other embodiments of the signal units would include conventional non-electric signage, signage with illuminated lettering, flashing arrows, or similarly illuminated signals.

As shown in FIG. 1, the support 44 engages with a clasp 40 mounted on the inner arm portion 28 to provide stability when in the folded transport position. In the embodiment shown, the inner arm portion 34 and the outer arm portion 35 form an angle of 30° in the folded position. The inner arm portion 34 and outer arm portion 35 may be made of four inch square tubing.

Referring to FIG. 2, a means for tilting the mast extension 13 with respect to the upright mast 12 is shown as a first hydraulic cylinder indicated by reference numeral 48. The hydraulic cylinder 48 is shown connected between the mast extension 13 and a mast support 49. The mast support 49 also operates as additional bracing for the upright mast 12. Alternate means for tilting the mast extension 13 would include conventional pneumatic cylinders, manual or motor driven linkages, gearing, or cable systems. Hydraulic lines, which are conventional, are not shown in the figures.

Referring to FIGS. 1, 3, and 4, a means for swinging the foldable arm 14 with respect to the mast extension 13 is shown as a second hydraulic cylinder 50. Alternate means would include conventional pneumatic cylinders, manual or motor driven linkages, gearing, or cable systems.

Referring to FIGS. 1, 3, and 4, a means for folding the inner and outer arm portions 34, 35 is comprised of a connecting link 51 connected between the mast extension 13 at a pivot point 51.1 on the bracket extension 51.2 protruding from the swing joint bracket 27.6 and the foldable arm 14 at the pivot point 51.3 on the connecting bracket 35.1. The connecting link 51, the swing joint bracket 27.6, the inner arm portion 34 and outer arm portion 35 of the foldable arm 14 form a four bar linkage 52 to couple the swinging of the foldable arm 14 at the swing joint 31 to the folding of the foldable arm 14 at the elbow joint 37. The linkages are appropriately sized and configured as shown in FIGS. 1 and 4 to provide approximately a 150° opening of the elbow joint 37 to a 60° opening of the swing joint 31.

The hydraulic operating controls as well as the electrical operating circuitry are conventional and are located in the control cabinet 58. Hydraulic lines are not shown in the figures.

FIG. 4 shows a front elevation of the apparatus 10 in the operating position with the mast extension 13 raised in the upright position and the foldable arm 14 in the fully extended position corresponding to the extension of the first hydraulic cylinder 48 and second hydraulic cylinder 50. The apparatus 10 is shown placed on the road shoulder 63 parallel to traffic on the roadway 64. The first signal unit 43 is shown extending out over the traffic lane 66 of the roadway 64 with adequate elevation for sufficient clearance over the truck 57, shown in phantom lines. The second signal unit 45 is shown elevated adjacent to the traffic lane 54.

FIG. 4 illustrates the advantageous weight distribution provided by the mast extension 13 angling away from the traffic lane 54. The second hydraulic cylinder 50, the bracket portion 36, the majority of the mast extension 13, part of the inner arm portion 34, and part of the connecting link 51 are disposed on the right side 22 of the trailer 15 with respect to the upright mast 12. This provides a significant counter balance effect allowing the foldable arm 14 to extend substantially farther out and over the traffic lane 66 with greater stability. This weight distribution also minimizes the bending moment on the upright mast 12 allowing reduction in the size and weight of the mast 12 and any bracing.

The apparatus 10 operates as follows: In the transport position as shown in FIGS. 1 and 2, the hydraulic cylinders 48, 50 are in their retracted position. Similarly, the foldable arm 14 is in its fully folded position. When the trailer 15 has been moved into position for use, the first hydraulic cylinder 48 is actuated to tilt the mast extension 13 upwardly as illustrated by the phantom lines in FIG. 2. In the fully extended or upright position the lower portion 27 of the mast extension 13 is in alignment with the upright mast 12. The top portion 28 of the mast extension 13 is angled in a direction away from the traffic lane 54 as shown in FIG. 3. In the preferred embodiment, the upper portion 27.5 of the mast extension 13 forms an angle of 150° with respect to the upright mast 12. The second hydraulic cylinder 50 is then pressurized to swing the inner arm portion 34 of the foldable arm 14 upwardly, as shown in FIG. 3, approximately 60° away from the mast extension 13 until the inner arm portion 34 of the foldable arm 14 becomes substantially horizontal as shown in FIG. 4.

Referring to FIGS. 3 and 4, as the second hydraulic cylinder 50 is actuated, swinging the inner arm portion 34 upwardly, the connecting link 51 moves substantially parallel to the inner arm portion 34 to unfold the outer arm portion 35 at the elbow joint 37. The connecting link 51 is appropriately configured to unfold the foldable arm 14 at the elbow joint 37 approximately 150° as the swing joint 31 opens approximately 60° . When the foldable arm 14 is fully unfolded the engagement surfaces 34.2, 35.2 make contact to secure the foldable arm 14 in the operating position. As the inner arm portion 34 is swung downward toward the mast extension 13, the foldable arm 14 correspondingly folds into the storage or transport position. The four bar linkage also creates a locking effect on both the elbow joint 37 and the swing joint 31 in both the operating position and the storage position.

Figure 5:
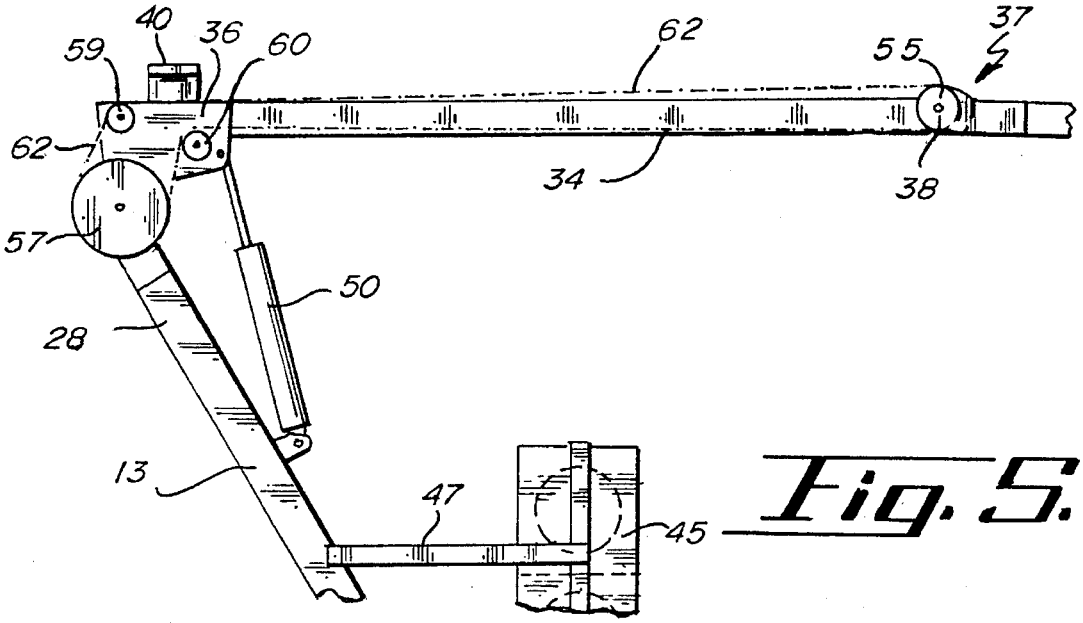
FIG. 5 shows a detail elevation view of portions of the mast extension and the foldable arm showing an alternate embodiment utilizing a chain mechanism.

An alternate means for folding the foldable arm 14 at the elbow joint 37 is shown in FIG. 5 and is comprised principally of the elbow joint sprocket 55 nonrotatably affixed to the outer arm portion 35 at the elbow joint 37, a swing joint sprocket 57 nonrotatably affixed to the mast extension 13 at the swing joint 31, two idler sprockets 59, 60 rotatably mounted on the bracket portion 36, and a chain 62 engaging the sprockets. As the second hydraulic cylinder 50 swings the inner arm portion 34 with the bracket portion 36 upward at the swing joint 31, the swing joint sprocket 57 is stationary with respect to the mast extension 13 thereby causing the chain 62 to move clockwise with respect to the idler gears 59, 60 and the inner arm portion 34. As the chain 62 moves clockwise the elbow joint sprocket 55 rotates in a clockwise direction. The elbow joint sprocket 55 is nonrotatably affixed to the outer arm portion 35 of the foldable arm 14 and therefore rotates the outer arm portion 35 with the elbow joint sprocket 55. The swing joint sprocket 57 and the elbow joint sprocket 55 are appropriately configured to unfold the foldable arm 14 from the fully folded position to the fully open position as shown in FIG. 5, as the inner arm portion 34 is tilted upwardly to a substantially horizontal position. In an appropriate configuration the large diameter swing joint sprocket 57 has sixty teeth and the smaller elbow joint sprocket 55 has twenty-four teeth. With the sprockets thus sized, the elbow joint 37 rotates 150° as the swing joint 31 rotates 60° . The idler sprocket 60 also can provide a chain tensioning adjustment by way of slidably and adjustably mounting the sprocket 60 on the bracket portion 36. Alternate conventional means for folding and unfolding the foldable arm 14 would include hydraulic or pneumatic cylinders, manual or motor driven gearing or winching systems.

It should be noted that the first and second hydraulic cylinders 48, 50 may be actuated simultaneously rather than sequentially as described above, to expedite placing the apparatus 10 in the operating position.

Fabrication of the portable folding standard and traffic signal apparatus may be accomplished by conventional welding and bolting of steel stock.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A portable folding standard and traffic signal apparatus for use along a roadway, the roadway having a shoulder and a traffic lane, the apparatus comprising:

a vehicle with support wheels and a rigid frame;

a stationary and rigid upright mast affixed on the vehicle frame, the upright mast having a top portion;

an elongate and tiltable mast extension hinged onto the top portion of the rigid upright mast and extending upwardly therefrom, the mast extension being tiltable to extend transversely of the upright mast, and the mast extension having an upper portion;

an elongate foldable arm extending transversely of the top portion of the mast extension in operating position to extend horizontally from the road shoulder and over the traffic lane of the road, and the foldable arm being swingably mounted on the mast and extension to lie along the mast extension in storage position, the foldable arm comprising inner and outer arm portions pivotally connected together and foldable to alternately lie along each other in a folded position and to extend in substantial alignment with each other in an extended position, said foldable arm swinging to lie along the mast extension in said storage position when the inner and outer arm portions are arranged in said folded position;

first means for tilting the mast extension to extend transversely of the stationary upright mast;

second means for swinging the foldable arm relative to the mast extension to lie substantially along the mast extension;

third means for alternately unfolding and folding the inner and outer arm portions of the foldable arm between said extended position and said folded position; and a traffic signal unit on the outer arm portion.

2. The apparatus according to claim 1, wherein the mast extension further comprises an elongate lower portion, the elongate lower portion hinged to the top portion of the upright mast and aligned with the upright mast, the upper portion of the mast extension extending obliquely of the lower portion of the mast extension.

3. The apparatus according to claim 2, wherein the vehicle frame has a substantially rectangular perimeter, said mast extension being confined within the rectangular perimeter of the vehicle frame when the mast extension is tilted to extend transversely of the upright mast.

4. The apparatus of claim 3, wherein the foldable arm also being confined within the perimeter of the vehicle frame when the foldable arm is arranged in said folded position and simultaneously lies along the mast extension in said storage position.

5. The apparatus according to claim 1 further comprising a second signal unit attached to the mast extension.

6. The apparatus according to claim 1, wherein the first means comprises a first power cylinder extending between the mast extension and the vehicle frame.

7. The apparatus according to claim 1, wherein the third means for folding the inner and outer arm portions is coupled to the second means for swinging the foldable arm, whereby the folding of the inner and outer arm portions between folded position and extended position occurs simultaneously with the swinging of the foldable arm between said operating position and said storage position.

8. The apparatus according to claim 1, wherein the second means for swinging the foldable arm comprises a second hydraulic cylinder connected between the mast extension and the inner arm portion.

9. The apparatus of claim 1, wherein the third means comprises a rigid link pivotally connected to and between the upper portion of the mast extension and the outer arm portion of the foldable arm and producing relative swinging of the inner and outer arm portions between extended position and folded position as the foldable arm is swung by said second means between operating position and storage position.

10. The apparatus of claim 9, wherein the second means comprises a second hydraulic cylinder connected between the mast extension and the inner arm portion.

11. The apparatus of claim 9, wherein the rigid link extends along said inner arm portion.

12. A portable folding standard and traffic signal apparatus for use along a roadway, the folding standard having an operating position and a transport position, the roadway having a shoulder and a traffic lane, the apparatus comprising:

a vehicle with support wheels and a rigid frame, the vehicle having a front, a back, and a side;

a folding standard comprising a stationary rigid upright mast, an elongate mast extension, and an elongate foldable arm, the folding standard convertible between an operating position and a transport position;

the upright mast affixed on the vehicle frame, the upright mast having a top portion;

the mast extension having a top portion and a lower portion, the mast extension hinged onto the top portion of the upright mast, whereby the mast extension is tiltable downwardly to extend transversely of the upright mast in a lowered position for the transport position, and the mast extension is tiltable upwardly into upright position for the operating position;

the foldable arm comprised of an inner arm portion and an outer arm portion pivotally connected together and foldable to alternately lie along each other in a folded position for the transport position and to extend endways of each other in an extended position for the operating position, the inner arm portion swingably connected to the top portion of the mast extension whereby the foldable arm lies along the mast extension in a storage position for the transport position and extends transversely of the upright mast and mast extension in an operating position for the operating position to extend horizontally from the shoulder and over the traffic lane;

a first means for tilting the mast extension relative to the upright mast to a lowered position;

a second means for swinging the foldable arm relative to the mast extension;

a third means for alternatingly folding the inner and outer arm portions of the foldable arm between said extended and folded position; and a traffic signal unit on the outer arm portion.

13. The apparatus according to claim 12, wherein the vehicle is a trailer.

14. The apparatus according to claim 12, wherein the mast extension further comprises a lower portion, the lower portion hinged to the top portion of the upright mast and aligned with the upright mast, the upper portion of the of the mast extension extending obliquely of the lower position.

15. The apparatus according to claim 13 further comprising a second signal unit attached to the mast extension.

16. The apparatus according to claim 12 further comprising a mast support affixed to the vehicle frame, the mast support attached between the frame and the upright mast, and wherein the first means for tilting the mast extension comprises a first hydraulic cylinder connected between the mast extension and the support.

17. The apparatus according to claim 12, wherein the third means for folding the inner and outer arm portions is coupled to the second means for swinging the foldable arm, whereby the folding of the inner and outer arm portions occurs simultaneously with the swinging of the foldable arm.

18. The apparatus according to claim 12, wherein the second means for swinging the foldable arm comprises a hydraulic cylinder connected between the mast extension and the inner arm portion.

19. The apparatus according to claim 12, wherein the third means comprises an elongate rigid link pivoted to both of the top portion of the upright mast and the outer arm portion of the foldable arm and producing relative unfolding of the inner and outer arm portions into extended position as the second means swings the foldable arm to operating position, and said rigid link also producing relative folding of the inner and outer arm portion of the foldable arm into folded position as the second means swings the foldable arm into storage position.

* * * * *